US010355411B2

(12) United States Patent
Wu

(10) Patent No.: US 10,355,411 B2
(45) Date of Patent: Jul. 16, 2019

(54) ASSEMBLY STRUCTURES OF CONNECTOR MODULE

(71) Applicant: DINKLE ENTERPRISE CO., LTD., New Taipei (TW)

(72) Inventor: Shang-Tsai Wu, New Taipei (TW)

(73) Assignee: DINKLE ENTERPRISE CO., LTD., New Taipei (TW)

( * ) Notice: Subject to any disclaimer, the term of this patent is extended or adjusted under 35 U.S.C. 154(b) by 0 days.

(21) Appl. No.: 16/052,367

(22) Filed: Aug. 1, 2018

(65) Prior Publication Data

US 2019/0027866 A1 Jan. 24, 2019

Related U.S. Application Data

(63) Continuation-in-part of application No. 15/653,100, filed on Jul. 18, 2017, now Pat. No. 10,079,454.

(51) Int. Cl.
*H01R 13/633* (2006.01)
*H01R 13/627* (2006.01)

(52) U.S. Cl.
CPC ..... *H01R 13/6335* (2013.01); *H01R 13/6273* (2013.01)

(58) Field of Classification Search
CPC .. H01R 13/6273; H01R 12/716; H01R 12/79; H01R 13/6335; H01R 12/721; H01R 12/73; H01R 13/506; H01R 13/62; H01R 13/6271; H01R 13/639
USPC ..... 439/358, 352, 630, 155, 157, 328, 345, 439/354, 357
See application file for complete search history.

(56) References Cited

U.S. PATENT DOCUMENTS 5,613,870 A * 3/1997 Traver, Jr. ..... H01R 13/6273 439/352
5,915,987 A * 6/1999 Reed ..... H01R 13/6275 439/258
7,435,131 B1 * 10/2008 Lee ..... H01R 12/79 439/354
7,883,350 B2 * 2/2011 Byrnes ..... H01R 13/6273 439/157
8,192,221 B2 * 6/2012 Schmettkamp ..... H01R 12/73 439/345
9,905,945 B2 * 2/2018 Wu ..... H01R 9/2425
2014/0179167 A1 * 6/2014 Long ..... H01R 12/7088 439/630
2014/0199866 A1 * 7/2014 Tang ..... H01R 12/7094 439/159

(Continued)

*Primary Examiner* — Edwin A. Leon
*Assistant Examiner* — Matthew T Dzierzynski
(74) *Attorney, Agent, or Firm* — Chun-Ming Shih; HDLS IPR Services

(57) ABSTRACT

A connector module includes a base, a conduct module and a pair of handles. The base includes a housing, an insertion space, and a pair of resilience arms. The conduct module is installed in the insertion space and is pressed and positioned by the pair of resilience arms. The conduct module includes a plug body and a plurality of conducting terminals disposed on the plug body. The pair of handles are coupled to opposite sides of the plug body and are capable of sliding with respect to the plug body respectively, the pair of handles are slidable in a direction away from the insertion space to take the conduct module disengaged from a press and a position of the pair of resilience arms so as to move out of the base.

6 Claims, 6 Drawing Sheets

(56) References Cited

U.S. PATENT DOCUMENTS

| | | | | |
|---|---|---|---|---|
| 2015/0104969 | A1* | 4/2015 | Teng | H01R 13/6275<br>439/358 |
| 2015/0207251 | A1* | 7/2015 | Fan | H01R 12/721<br>439/630 |
| 2018/0069359 | A1* | 3/2018 | Muller | H01R 9/2658 |

* cited by examiner

ASSEMBLY STRUCTURES OF CONNECTOR MODULE

CROSS-REFERENCE TO RELATED APPLICATION

This application is a continuation-in-part application of U.S. patent application Ser. No. 15/653,100, filed on Jul. 18, 2017, and entitled "ASSEMBLY STRUCTURES OF CONNECTOR MODULE". The entire disclosures of the above application are all incorporated herein by reference.

BACKGROUND OF THE INVENTION

Field of the Invention

The present invention generally relates to a connector and, in particular to assembly structures of a connector module.

Description of Prior Art

The traditional assembly structures of a connector include a base and a plurality of terminal holes disposed in the base, wherein the terminal holes are provided for plugging terminals of another connector for transmitting signals or power.

When the connector has a problem with the transmission of signal or power, the entire connector module has to be sent to repair when the terminal holes have problems, for instance. If one terminal of the connector module is broken, the whole connector module has to be discarded. That will not only cause material waste and environmental pollution, but also be one of the reasons for the increase of costs.

Moreover, terminal holes of a conventional terminal block connector are disposed in a terminal block connector (plug body), in which the terminal block is separable and locked on the base through screws. Although the terminal block can be disassembled for maintenance or disposal, the screws must be removed by hand tools (such as screwdrivers) before removing the terminal block. Therefore, the maintenance of the terminal block is quite inconvenient.

In view of the above drawbacks, the Inventor proposes the present invention based on his expert knowledge and elaborate researches in order to solve the problems of prior art.

SUMMARY OF THE INVENTION

Accordingly, an object of the present invention is to provide assembly structures of connector module, in which additional tools are not needed for the removal of the conduct module, and the conduct module can be removed directly from the base by means of gripping the handle so as to facilitate the maintenance or operations of electrical connection for increasing the convenience of using.

Accordingly, an object of the present invention is to provide assembly structures of connector module, in which the handle can slide in a direction away from the base so that it can be capable of taking the conduct module removed away from the press and position of the resilience arm to move out the base.

In order to achieve the object mentioned above, the present invention provides assembly structures of a connector module including a base, a conduct module and a pair of handles. The base includes a housing, an insertion space, and a pair of resilience arms. The conduct module is installed in the insertion space and is pressed and positioned by the pair of resilience arms. The conduct module comprises a plug body and a plurality of conducting terminals disposed thereon. The pair of handles are coupled to opposite sides of the plug body and are capable of sliding with respect to the plug body respectively, wherein the pair of handles are slidable in a direction away from the insertion space to take the conduct module disengaged from the press and position of the pair of resilience arms so as to move out of the base.

Comparing to the prior art, the pair of resilience arms have disposed in the insertion of the base of the connector module in the present invention. The conduct module can be installed in the insertion space and pressed by the pair of the resilience arms. In addition, a pair of handles is coupled on opposite sides of the plug body and contacts the pair of resilience arms respectively so as to slide with respect to the plug body. Thus, the handle can slide in a direction away from the base and take the conduct module removed away from the press and position of the resilience arm so as to move out the base. Thereby, the removal of the conduct module does not need additional tools and can be removed directly from the base by means of gripping the handle so as to facilitate the maintenance or operations of electrical connection for increasing the convenience of use.

BRIEF DESCRIPTION OF DRAWING

The features of the invention believed to be novel are set forth with particularity in the appended claims. The invention itself, however, may be best understood by reference to the following detailed description of the invention, which describes a number of exemplary embodiments of the invention, taken in conjunction with the accompanying drawings, in which:

DETAILED DESCRIPTION OF THE PREFERRED EMBODIMENTS

In cooperation with attached drawings, the technical contents and detailed description of the invention are described thereinafter according to a number of preferable embodiments, being not used to limit its executing scope. Any equivalent variation and modification made according to appended claims is all covered by the claims claimed by the present invention.

Figure 1:
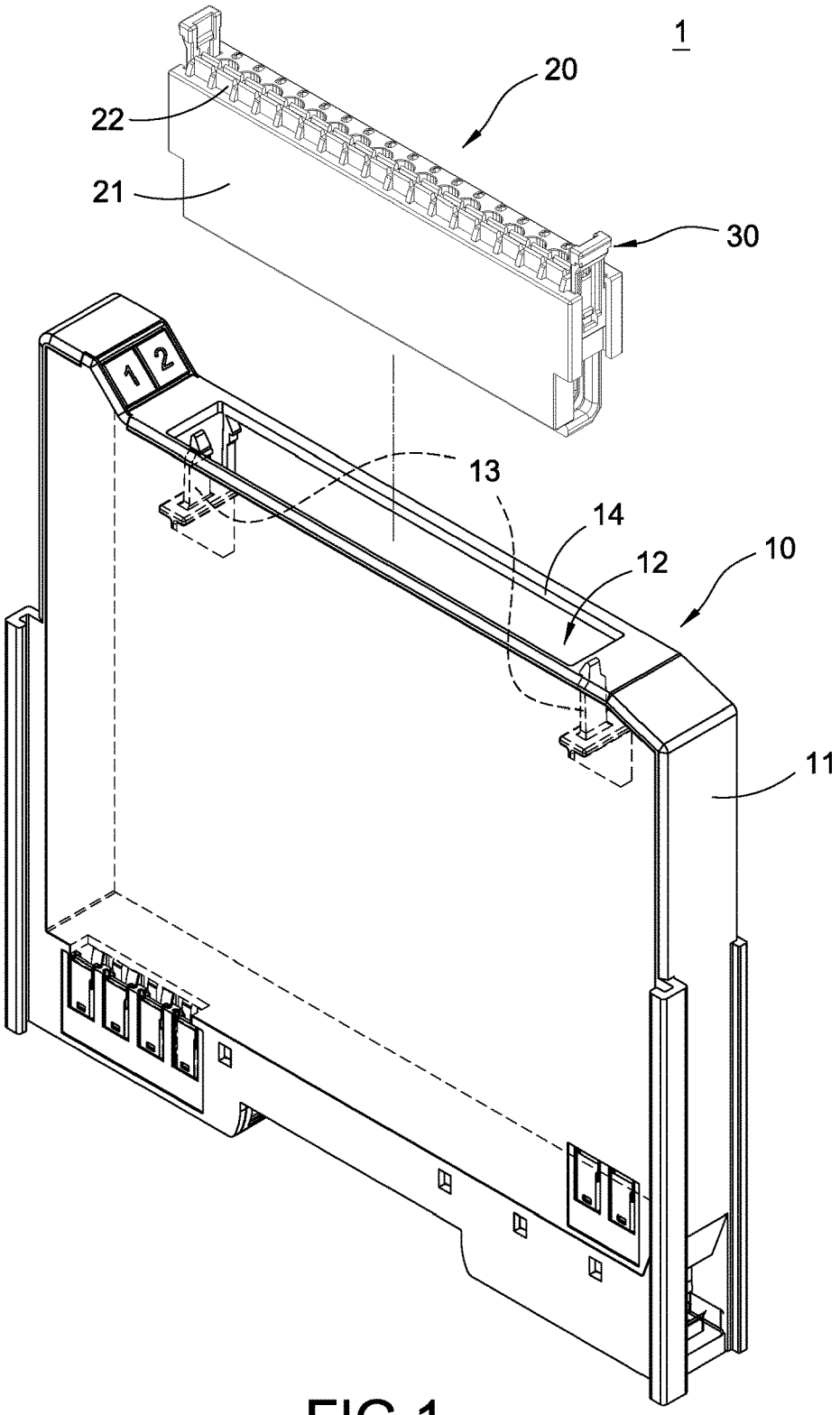
FIG. 1 is a perspective assembly schematic view a connector module of the present invention.

Please refer to FIG. 1, which depicts a perspective assembly schematic view a connector module of the present invention. The connector module 1 of the present invention includes a base 10, a conduct module 20 and a pair of handles 30. The pair of handles 30 is coupled to the conduct module 20. The conduct module 20 is inserted and positioned in the base 10, and the conduct module 20 inserted in the base 10 is in a detachable manner. Moreover, users do not need additional tools for the removal of the conduct module 20, and the conduct module 20 can be removed directly from the base 10 by means of gripping the handles 30 so as to facilitate the maintenance or operations of electrical connection. The connector module 1 is described in more detail as follows.

Figure 2:
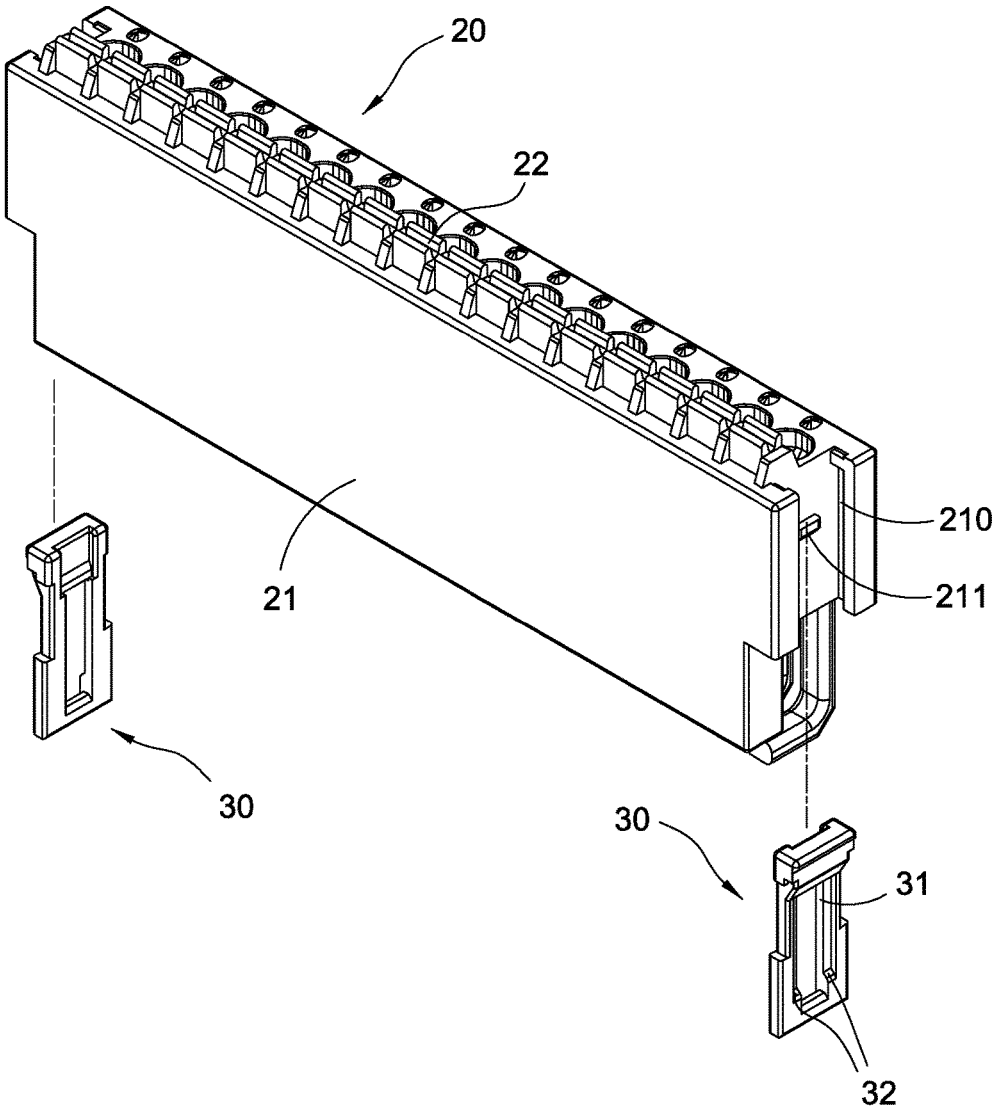
FIG. 2 is an assembly schematic view of the conduct module and the handle of the present invention.
Figure 3:
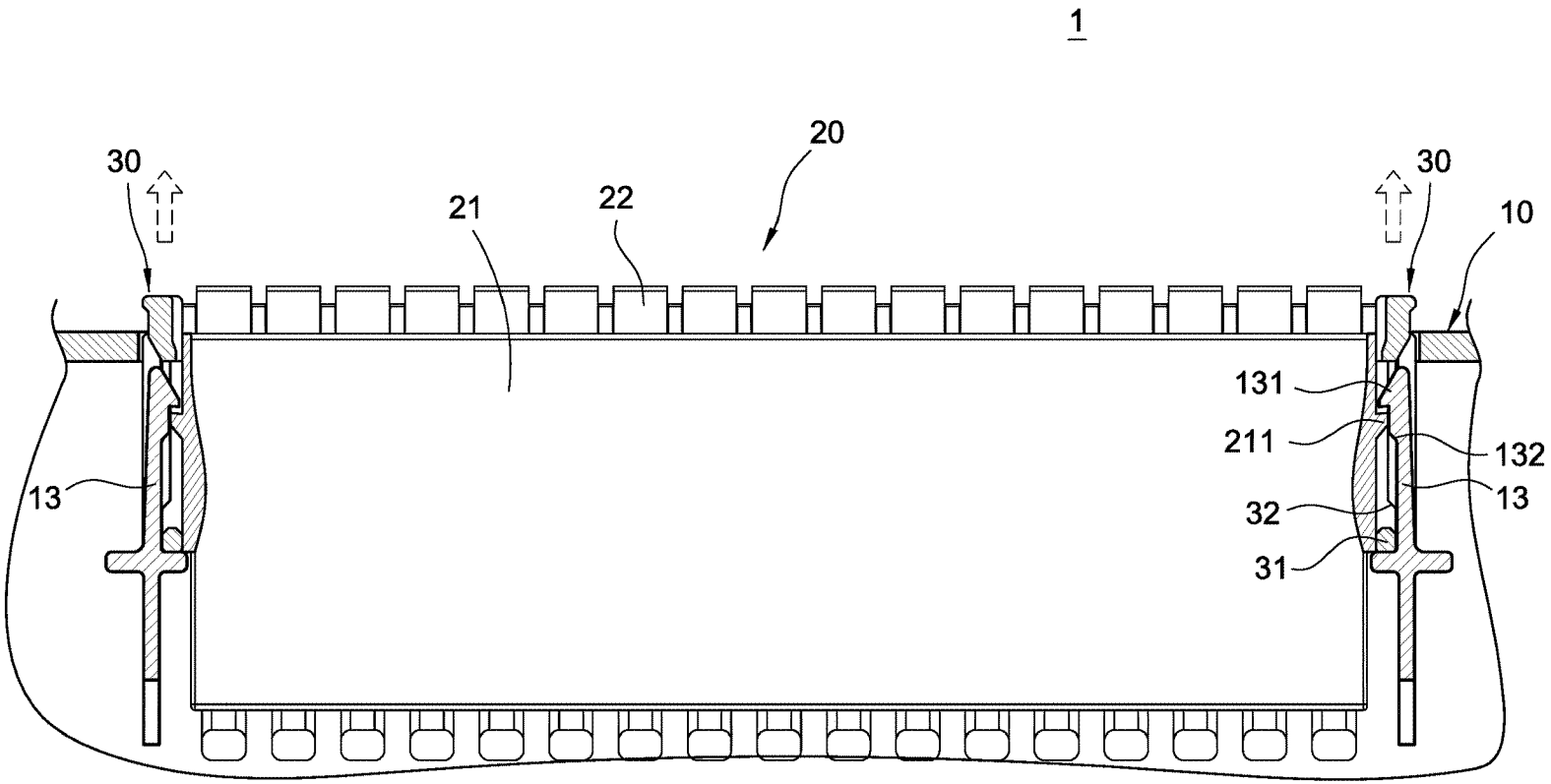
FIG. 3 is a cross sectional view of the assembly of the conduct module and the handle of the present invention.

Please further refer to FIG. 2 and FIG. 3, which depict an assembly schematic view of the conduct module and the handle of the present invention, and a cross sectional view of the assembly of the conduct module and the handle of the present invention. The base 10 includes a housing 11, an insertion space 12 formed inside the housing 11 and having an opening 14 formed on one side of the housing 11, and a pair of resilience arms 13 disposed in the insertion space 12. In the present invention, the base 10 is substantially, but not limited to, a rectangular. In addition, the pair of handles 30 are located on opposite sides of the insertion space 12 and formed with the housing 11 as an integral body.

The conduct module 20 is installed in the insertion space 12 and is pressed and positioned by the pair of resilience arms 13. The conduct module 20 comprises a plug body 21 disposed inside the insertion space 12 and a plurality of conducting terminals 22 formed on the plug body 21 to protrude out of the opening 14.

Moreover, the pair of handle 30 is coupled to the opposite sides of the plug body 21. Besides, the pair of handles 30 are contacted with the pair of resilience arms 13 correspondingly and are capable of sliding with respect to the plug body 21 respectively, wherein the pair of handles 30 are slidable in a direction away from the insertion space 12 to take the conduct module 20 disengaged from a press and position of the pair of resilience arms 13 so as to move out of the base 10.

In the present embodiment, the plug body 21 has a sliding slot 210 on opposite sides thereof respectively, and each handle 30 is disposed in the sliding slot 210 and slides between the pair of resilience arms 13 and the plug body 21. Preferably, the plug body 21 has a limiting block 211 in the sliding slot 210; thus the handle 30 is restricted by the limiting block 211 so that the handle 30 will not move out the sliding slot 210. Therefore, the pair of handles 30 can be held on opposite sides of the plug body 21.

Specifically, one end of the resilience arm 13 has a hook 131, and the hook 131 is abutted against the limiting block 211 of the plug body 21. On the other hand, the hand 30 has a limiting frame 31, and the limiting block 211 is capable of sliding in the limiting frame 31 and blocks one side of the limiting frame 31. Thereby, the limiting block 211 blocks one side of the limiting frame 31 so that the handle 30 will not move out the sliding slot 210.

Figure 4:
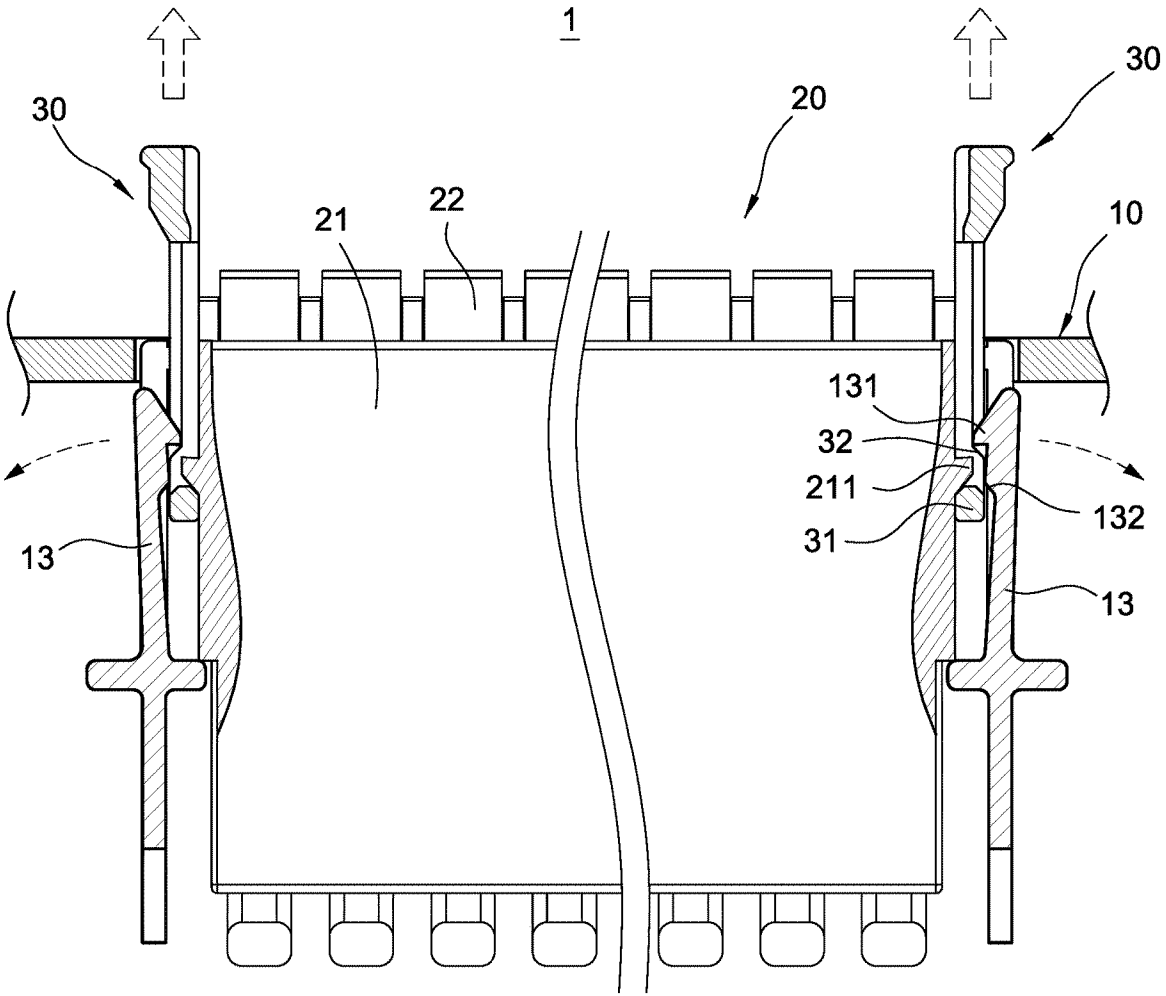
FIG. 4 is a removing schematic view of the conduct module of the present invention.
Figure 5:
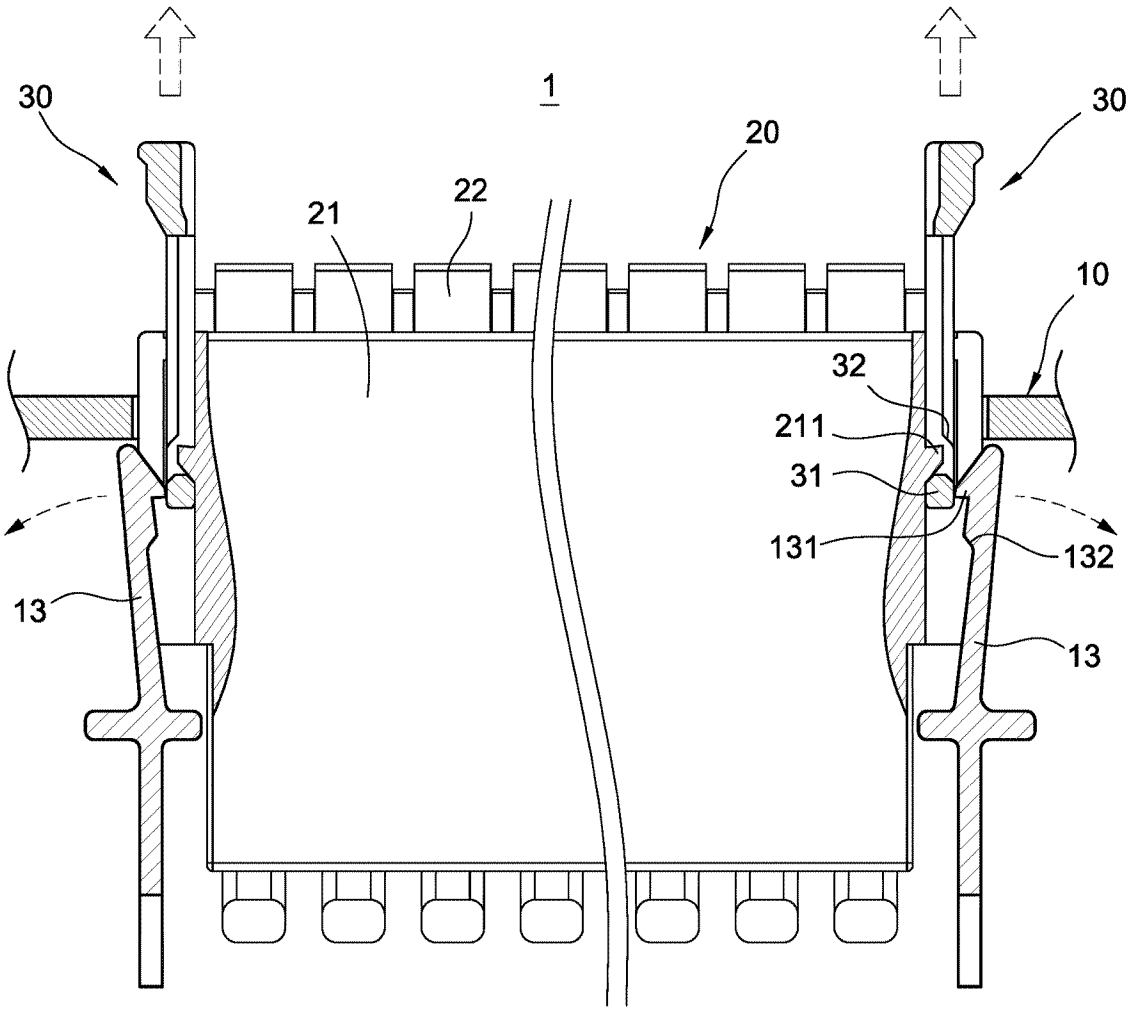
FIG. 5 is an operating schematic view of the resilience arm of the present invention.
Figure 6:
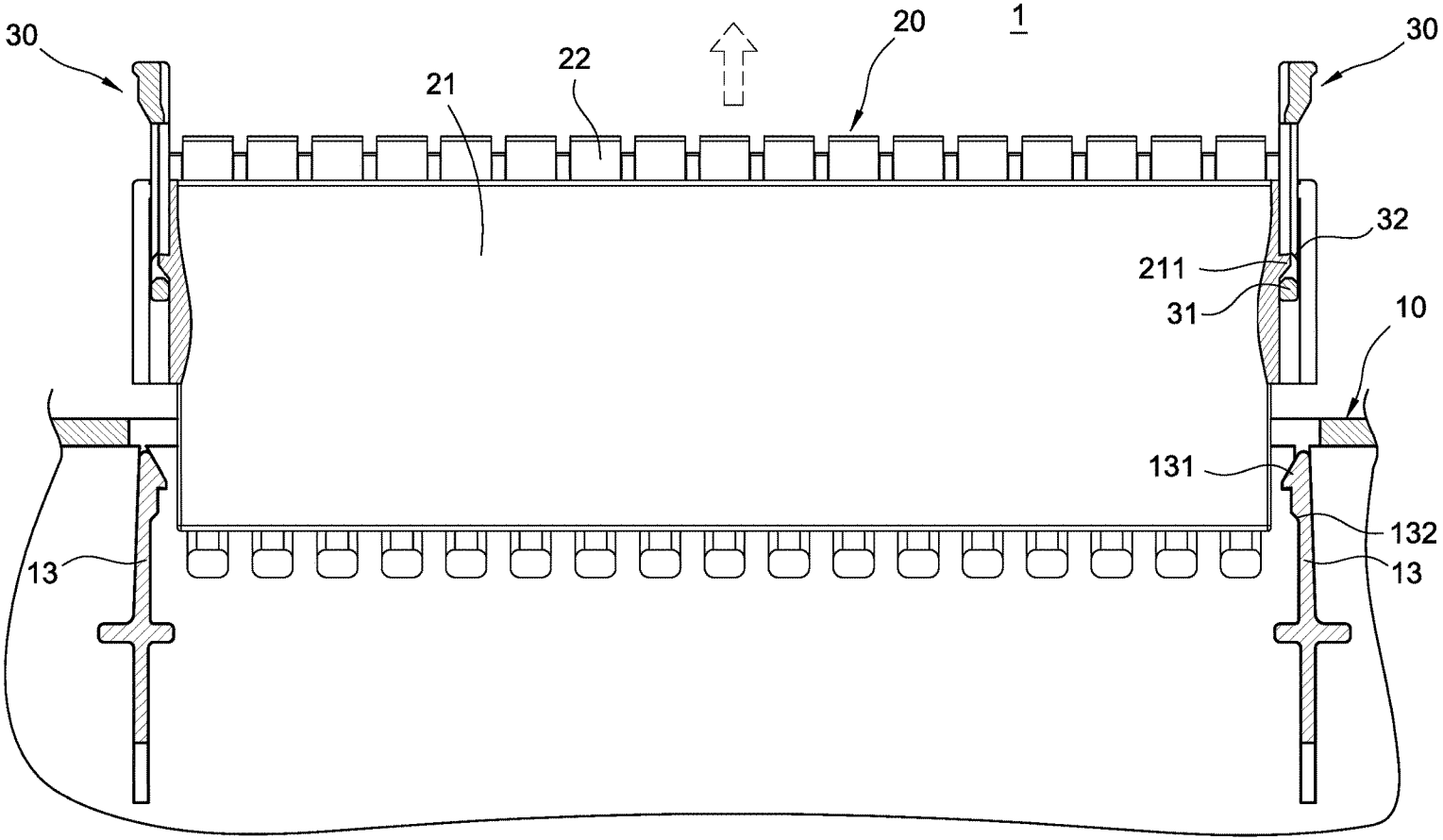
FIG. 6 is a schematic view of the removal conduct module of the present invention.

Please also refer to FIG. 4 to FIG. 6, which depict a removing schematic view of the conduct module of the present invention, an operating schematic view of the resilience arm of the present invention, and a schematic view of the removal of the conduct module of the present invention. When the conduct module 20 of the present invention is to be taken out, the conduct module 20 can be taken out of the base 10 by gripping the pair of handles 30 without using additional hand tools.

With referring to FIG. 4, in the present embodiment, the handle 30 has an inclined surface 32 on a side facing the resilience arm 13. Preferably, the inclined surface 32 is formed at a bottom side of the limiting frame 31. Moreover, the resilience arm 13 is moved in a direction away from the plug body 21 by a push of the incline surface 32.

On the other hand, the resilience arm 13 further has a pushed incline plane 132 on a side facing the handle 30. Preferably, the pushed incline plane 132 is located at a bottom of the hook 131. Besides, the conduct module 20 is disengaged from the press and the position of the resilience arm 13 by the inclined surface 32 of the handle 30 pushing the pushed incline plane 132.

Please refer to FIG. 5, when handle 30 slides in a direction away from the insertion space 12, the resilience arm 13 is moved in a direction away from the plug body 21 by a push of the handle 30. In the meantime, the conduct module 20 is disengaged from the press and position of the pair of the handles 30 so as to move out the base 10.

As shown in FIG. 6, the conduct module 20 which is positioned in the base 10 can be directly taken out by gripping the pair of the handles 30 for increasing the convenience of using.

Although the present invention has been described with reference to the preferred embodiment thereof, it will be understood that the invention is not limited to the details thereof. Various substitutions and improvements have been suggested in the foregoing description, and others will occur to those of ordinary skill in the art. Therefore, all such substitutions and improvements are intended to be embraced within the scope of the invention as defined in the appended claims.

What is claimed is:

1. A connector module, comprising:

a base including a housing, wherein an insertion space is formed in the housing and has an opening formed on one side of the housing, and a pair of resilience arms are disposed in the insertion space;

a conduct module installed in the insertion space and being pressed and positioned by the pair of resilience arms; the conduct module including a plug body disposed inside the insertion space and a plurality of conducting terminals formed on the plug body to protrude out of the opening; and a pair of handles coupled to opposite outer sides of the plug body; the pair of handles connecting with the pair of resilience arms correspondingly and being capable of sliding with respect to the plug body, wherein the pair of handles are slidable in a direction away from the insertion space to make the conduct module to be disengaged from the pair of resilience arms so as to move out of the base;

wherein the plurality of conducting terminals are disposed on the plug body between the pair of handles;

wherein the plug body has a sliding slot on opposite sides, and each handle is disposed in the sliding slot and slides between the pair of resilience arms and the plug body;

wherein the plug body has a limiting block in the sliding slot, and the pair of handles are restricted by the limiting block so that the pair of handles will not move out the sliding slot;

wherein one end of each resilience arm has a hook, and the hooks are abutted against the limiting block of the plug body wherein the handle has a limiting frame, and the limiting block is capable of sliding in the limiting frame and blocks one side of the limiting frame.

2. The connector module according to claim 1, wherein each handle has an inclined surface on a side facing the resilience arm; the resilience arm is pushed by the incline surface and moved in a direction away from the plug body.

3. The connector module according to claim 2, wherein the inclined surface is formed at a bottom side of the limiting frame.

4. The connector module according to claim 2, wherein the resilience arm has a pushed incline plane on a side facing the handle; the inclined surface of the handle pushes the pushed incline plane so that the conduct module is disengaged from the press and the position of the resilience arm.

5. The connector module according to claim 4, wherein the pushed incline plane is located at a bottom of the hook.

6. The connector module according to claim 1, wherein the pair of the resilience arms are located on opposite sides of the insertion space and formed with the housing as an integral body.

* * * * *